US008857630B2

(12) United States Patent
Zirkle

(10) Patent No.: US 8,857,630 B2
(45) Date of Patent: Oct. 14, 2014

(54) STRUCTURE AND METHOD FOR CARRYING AND ACCESSING DRYWALL WORKING KNIVES

(76) Inventor: Randell Lee Zirkle, Tucson, AZ (US)

( * ) Notice: Subject to any disclaimer, the term of this patent is extended or adjusted under 35 U.S.C. 154(b) by 0 days.

(21) Appl. No.: 13/304,159

(22) Filed: Nov. 23, 2011

(65) Prior Publication Data

US 2012/0125871 A1 May 24, 2012

Related U.S. Application Data

(60) Provisional application No. 61/458,508, filed on Nov. 24, 2010.

(51) Int. Cl.
*A45C 13/02* (2006.01)
*B25H 3/00* (2006.01)

(52) U.S. Cl.
CPC ..... *A45C 13/012* (2013.01); *B25H 3/00* (2013.01)
USPC ..... 211/70.6

(58) Field of Classification Search
CPC ..... B65H 3/00; B65H 3/02; A45C 13/02
USPC ..... 211/70.6, 65, 70.7, 13.1, 85.8; 206/372, 206/375, 349
See application file for complete search history.

(56) References Cited

U.S. PATENT DOCUMENTS

| | | | | | |
|---|---|---|---|---|---|
| 407,524 | A * | 7/1889 | Hall | 206/209 |
| 1,661,121 | A * | 2/1928 | Huson | 206/372 |
| 2,020,394 | A * | 11/1935 | Bates | 206/362 |
| 2,080,655 | A * | 5/1937 | Crawford | 206/209 |
| 2,278,650 | A * | 4/1942 | Drinkwater | 211/65 |
| D148,431 | S * | 1/1948 | Lund | D28/74 |
| 2,899,077 | A * | 8/1959 | Timms | 211/70.6 |
| 3,870,148 | A * | 3/1975 | Hite | 206/372 |
| 4,303,188 | A * | 12/1981 | Calabrese | 224/674 |
| 4,416,372 | A * | 11/1983 | Polk | 206/372 |
| 4,497,412 | A * | 2/1985 | Labelle | 211/70.7 |
| 5,046,624 | A * | 9/1991 | Murphy et al. | 211/70.6 |
| 5,505,303 | A * | 4/1996 | Sirman | 206/373 |
| 5,740,910 | A * | 4/1998 | Ueng | 206/373 |
| 6,126,003 | A * | 10/2000 | Brouard | 206/372 |
| 6,318,567 | B1 * | 11/2001 | Braley | 211/70.7 |
| D462,168 | S * | 9/2002 | Klemmensen et al. | D3/279 |
| 6,729,439 | B1 * | 5/2004 | Zlatis et al. | 182/129 |
| 6,823,992 | B2 * | 11/2004 | Redzisz | 206/373 |
| 6,945,442 | B2 * | 9/2005 | Godshaw et al. | 224/607 |
| 7,048,101 | B2 * | 5/2006 | Godshaw et al. | 190/18 A |
| 7,150,345 | B2 * | 12/2006 | Redzisz | 190/111 |
| 7,290,656 | B1 * | 11/2007 | Crawford | 206/349 |
| 7,331,454 | B2 * | 2/2008 | Godshaw et al. | 206/373 |
| 2003/0042093 | A1 * | 3/2003 | Godshaw et al. | 190/115 |
| 2004/0222175 | A1 * | 11/2004 | Keating et al. | 211/85.13 |
| 2006/0011502 | A1 * | 1/2006 | Redzisz | 206/373 |
| 2007/0056868 | A1 * | 3/2007 | Godshaw et al. | 206/373 |
| 2010/0108452 | A1 * | 5/2010 | Williams et al. | 190/18 A |

* cited by examiner

*Primary Examiner* — Jonathan Liu
*Assistant Examiner* — Stanton L Krycinski

(57) ABSTRACT

The present invention relates to a way of supporting and transporting drywall working knives such as joint knives, in such a way that the working knives are conveniently transported during a project that involves use of the knives, and are conveniently accessible to a user when the knives are being used. Once used, the knives can be supported for transport to another use location or for storage for the next project. A support for the working knives comprises support member configured to be located inside a portable bag (preferably at the bottom of the portable bag). The support member has slots, each of which is configured to support the blade of a working knife in a manner with the knife in an upright orientation with the handle of the knife proximate the opening in the bag, so that the working knife is conveniently accessible to a user of the knife.

2 Claims, 3 Drawing Sheets

STRUCTURE AND METHOD FOR CARRYING AND ACCESSING DRYWALL WORKING KNIVES

RELATED APPLICATION/CLAIM OF PRIORITY

This application is related to and claims priority from provisional application Ser. No. 61/458,508, filed Nov. 24, 2010, which provisional application is incorporated by reference herein.

INTRODUCTION AND SUMMARY OF THE PRESENT INVENTION

The present invention relates to a way of supporting and transporting working knives, e.g. drywall working knives such as joint knives, in such a way that the working knives are conveniently transported during a project that involves use of the knives, and are conveniently accessible to a user when the knives are being used. Once used, the invention provides for transporting the knives to another use location or for storage for the next project.

According to the invention, a support for the working knives comprises a support member configured to be located inside a portable bag (preferably at the bottom of the portable bag). The support member has slots, each of which is configured to support the blade of a working knife in a manner with the knife in an upright orientation with the handle of the knife proximate the opening in the bag, so that the working knife is conveniently accessible to a user of the tool.

During a project that involves the transport and use of the working knives, the support member is located in the portable bag, and the knives are supported by the support member, with the knife blades located in the slots in the support member, with the knives in an upright orientation with the handles of the knives located proximate to the opening in the bag, so that the working knives are conveniently accessible to a user of the knives. In that condition, the portable bag can be carried to a location at which the working knives are to be used. A knife is then removed from the bag by grasping the handle of the working knife while the tool is supported in the portable bag, removing the working tool, so that the knife can be used for the project. After the working knife has been used, the blade of the working knife is placed in one of the slots in the support member, to support the working knife in the orientation with the handle located proximate the opening in the bag, to enable the working knife to be carried to another use location, or carried to a location where the working tool can be stored.

Further features of the present invention will be apparent from the following detailed description and the accompanying drawings

DETAILED DESCRIPTION

As described above, the present invention relates to a structure and method for carrying drywall working knives to a use location, and accessing the knives at the working location. The principles of the invention are particularly applicable to drywall working knives such as joint knives that have relatively wide blades and handles at the ends of the blades. The principles of the invention are described herein in connection with such joint knives for a drywall application, and from that description the manner in which the principles of the present invention can be used with various types of drywall working knives will be apparent to those in the art.

Figure 1:
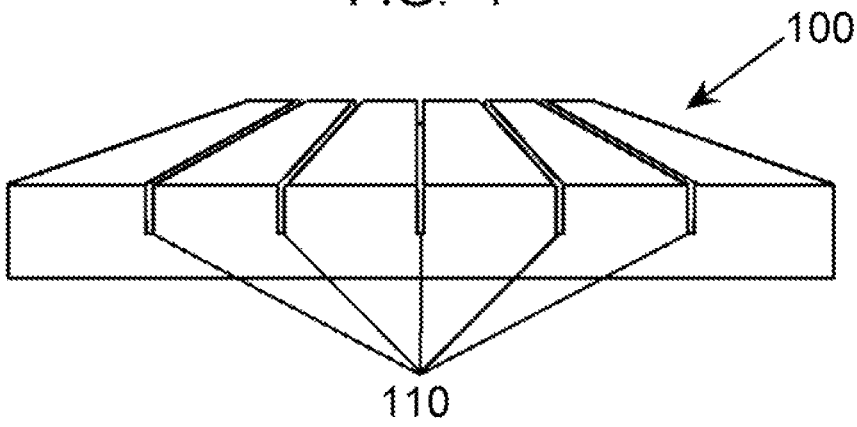
FIG. 1 is an illustration of a support member for supporting drywall working knives, in accordance with the principles of the present invention.
Figure 2:
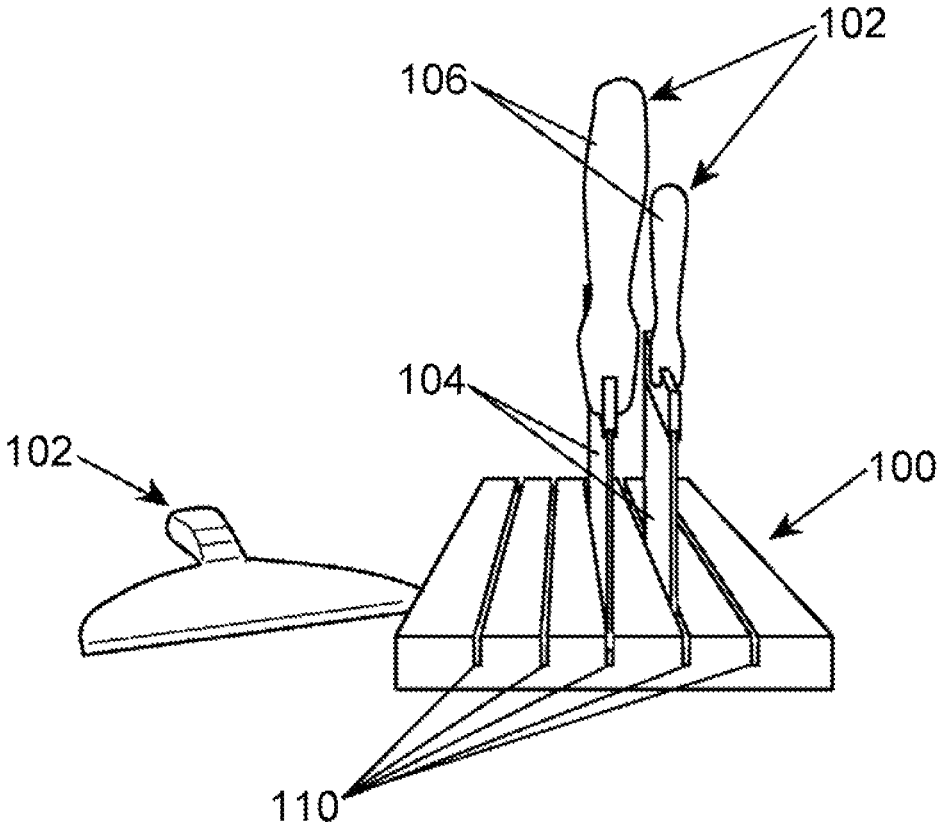
FIG. 2 is a side illustration of the support member with drywall working knives supported thereby, in accordance with the principles of the present invention.

FIGS. 1-2 illustrate a support member 100 for supporting drywall working knives, in accordance with the principles of the present invention. The support member 100 is designed to support drywall working knives such as joint knives 102 for use in a drywall application. The knives 102 each has a relative wide blade 104 with a handle 106 located at an end of the blade. The blade 104 is designed to scrape or spread drywall material, as is well known to those in the art. The handle 106 is connected to the blade 104 in a manner such that the blade can be conveniently manipulated to spread or scrape drywall material.

FIG. 2 shows the manner in which the support member supports drywall knives 102 in accordance with the principles of the present invention. The support member 100 preferably comprises a block shaped member with a series of slots 110 formed therein. The support member 100 can be formed of a synthetic material (e.g. a plastic), and the slots 110 have a width slightly narrower than a drywall knife blade, such that a knife blade will fit tightly in a slot, that is just tight enough to hold the knife upright in the manner described herein, but will allow a knife to be removed from the slot with a relatively small amount of manual force. The depth of the slots 110 is also designed to enable the drywall knife blade to be supported and held in an upright orientation with the handle 106 of the knife extending upward, while also allowing a knife to be removed from the slot with a relatively small amount of manual force.

Figure 3:
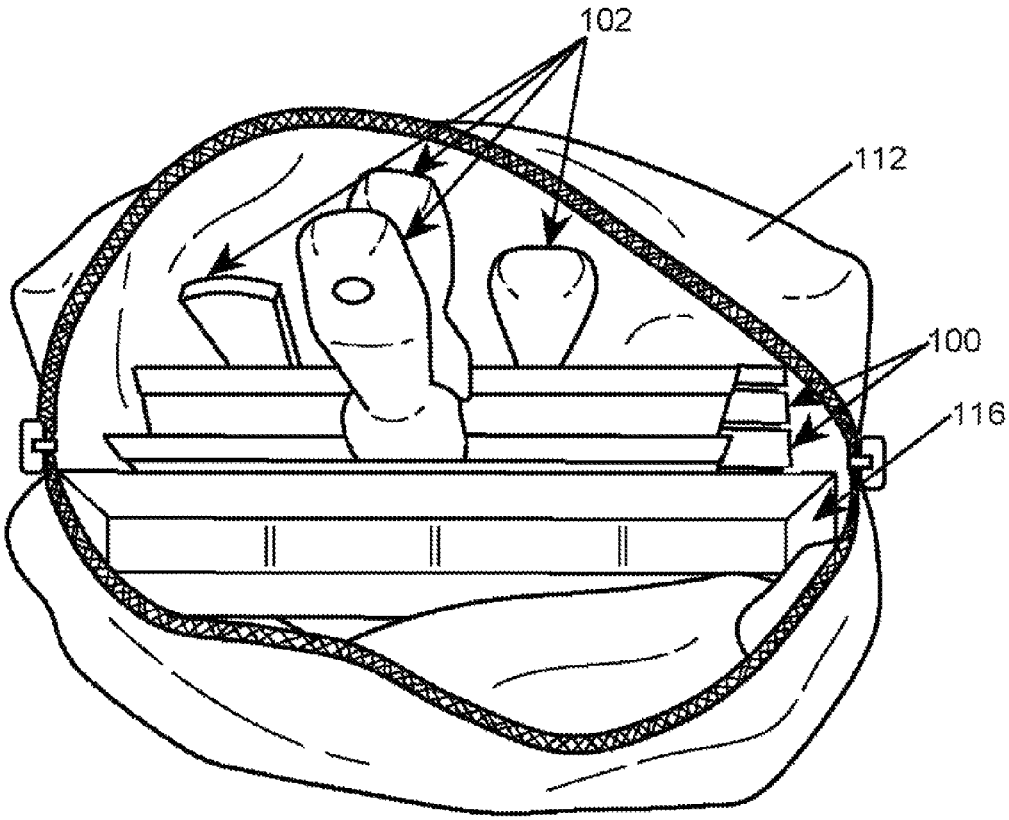
FIG. 3 is an illustration of the portable bag, with the support member of FIGS. 1-2 located therein, and supporting working knives in the portable bag, and also including a pan for supporting a mixture with which the working knives can be used, in accordance with the principles of the present invention.
Figure 4:
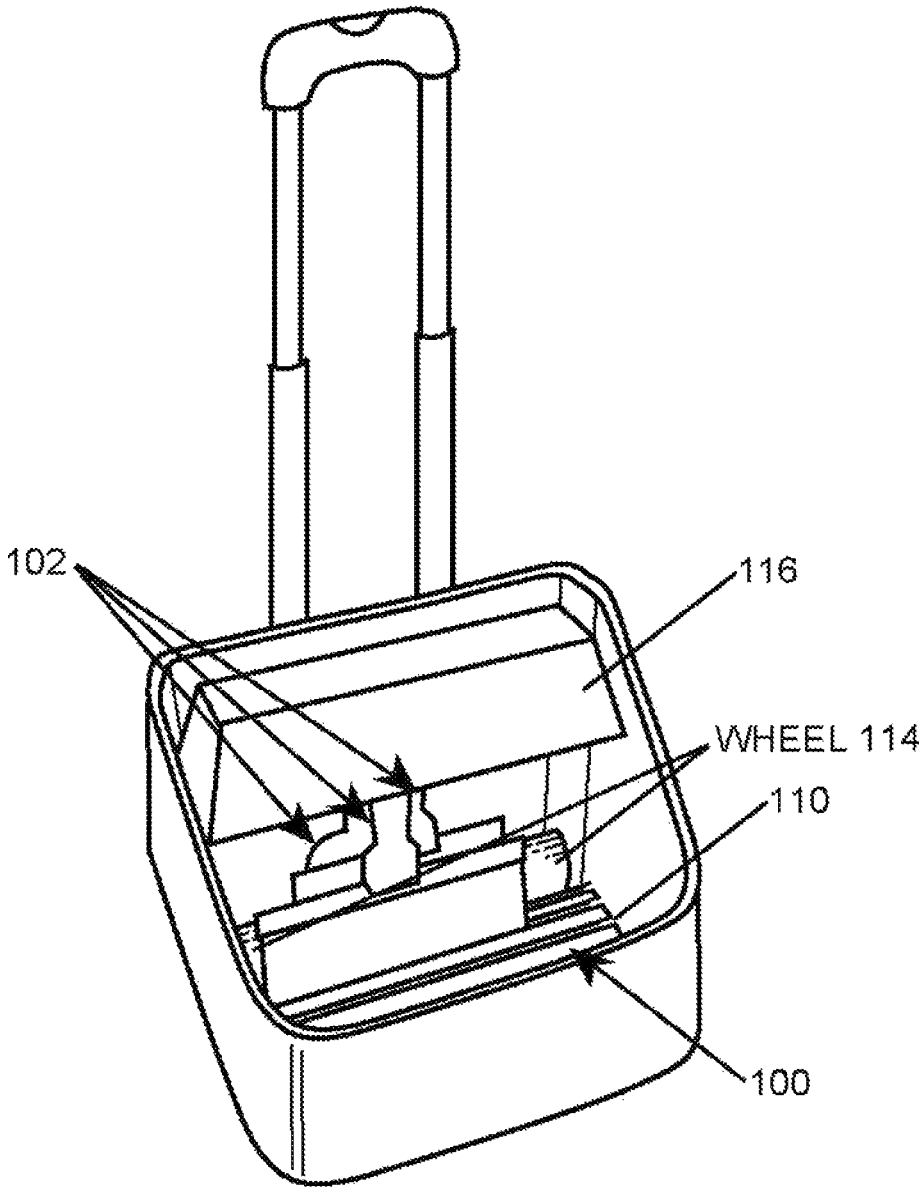
FIG. 4 is an illustration of another type of portable bag, with the support member of FIGS. 1-2 located therein, and supporting working knives in the portable bag, in accordance with the principles of the present invention.

The support member 100 is located inside a portable bag 112 (preferably at the bottom of the portable bag). The slots in the support member face upward, toward the open end of the portable bag 112 (see FIGS. 3 and 4). Thus, when one or more drywall knives 102 are supported with their blades located in the slots, the knives will all be oriented in an upward orientation, with the handles of the knifes proximate the opening in the bag, so that each of the drywall knives is conveniently accessible to a user of the tool. FIG. 3 illustrates one type of portable bag 112 that can be hand carried to a project location. FIG. 4 illustrates another type of portable bag, that can be supported on a rolling structure that comprises wheels 114 to enable the portable bag to be conveniently rolled as it is being moved to a project location.

In each of FIGS. 3 and 4, the support member 100 is located at the bottom of the portable bag, with the slots facing upward toward the opening in the bag. The knives 102 are supported with their blades 104 located in the slots, the knives extending upward from the blades with the handles 106 of the knives located proximate the opening in the bag. As shown in FIG. 3, a pan 116 for the drywall material can also be located in the bag. Thus, the bag can be moved to a drywall project location, to carry both the knives 102, the pan 116 and other drywall materials to the project location. At the project location, the pan can be used to contain the drywall material. Each of the knives 102 is conveniently accessible to a drywall operator at the use location, because all the operator has to do is to reach into the bag, grasp the handle 106 of a drywall knife, and remove the drywall knife from the bag. Then after the operator is finished with the drywall knife, the knife can be easily and conveniently returned to the bag by placing the blade of the knife in one of the slots in the support member.

The invention claimed is:

1. A portable drywall working knife and pan apparatus comprising:

a portable bag comprising wheels, a handle, and an interior compartment having an open end;

a support member comprising a support block having a plurality of horizontal slots on a top surface thereof, each slot removably supporting a blade of a drywall working knife in an upright orientation such that a handle of the knife is approximate the open end of the bag above the blade, said support member located at a bottom of the portable bag within the interior compartment;

a pan for drywall material, said pan located within the interior compartment above and adjacent to the support member and supported on top of the handles of the working knives in an inverted position;

wherein the apparatus is configured to be carried to a location at which the pan and the working knives are to be used such that the working knives are removable and replaceable within the slots of the support block at separate locations.

2. A method of carrying and accessing said drywall working knives and said pan for drywall material of claim 1, comprising:

carrying the portable bag to a location at which the pan and the working knives are to be used, using the pan to contain drywall material, grasping one of the working knives while the knife is supported in the portable bag, removing the working knife; and after the working knife has been used to apply drywall material contained in the pan, placing the blade of the working knife in one of the slots in the support block, to enable the working knife to be carried to another location.

* * * * *